US011089917B2

(12) United States Patent
Clifton

(10) Patent No.: US 11,089,917 B2
(45) Date of Patent: Aug. 17, 2021

(54) TOILETRY WIPING DEVICE

(71) Applicant: Garry Clifton, Park City, UT (US)

(72) Inventor: Garry Clifton, Park City, UT (US)

( * ) Notice: Subject to any disclaimer, the term of this patent is extended or adjusted under 35 U.S.C. 154(b) by 131 days.

(21) Appl. No.: 15/358,905

(22) Filed: Nov. 22, 2016

(65) Prior Publication Data

US 2017/0143173 A1 May 25, 2017

Related U.S. Application Data

(60) Provisional application No. 62/258,706, filed on Nov. 23, 2015.

(51) Int. Cl.

| | |
|---|---|
| ***A47K 7/08*** | (2006.01) |
| ***A47K 7/06*** | (2006.01) |
| *A47K 7/02* | (2006.01) |
| *A47K 17/00* | (2006.01) |
| *A47L 13/16* | (2006.01) |

(52) U.S. Cl.

CPC ..... *A47K 7/08* (2013.01); *A47K 7/06* (2013.01); *A47K 7/02* (2013.01); *A47K 2017/006* (2013.01); *A47L 13/16* (2013.01)

(58) Field of Classification Search

CPC ..... A47K 7/08; A47K 7/02; A47K 2017/006; A47K 7/06; A47L 13/16

USPC ..... 15/210.1, 143.1, 244.1, 104.001, 145

See application file for complete search history.

(56) References Cited

U.S. PATENT DOCUMENTS

| | | | | |
|---|---|---|---|---|
| 867,080 | A * | 9/1907 | Rife | A47L 13/257 15/154 |
| 5,044,040 | A | 9/1991 | Tetrault | |
| 6,272,716 | B1 | 8/2001 | Thornton | |
| 6,689,224 | B1 | 2/2004 | Hillman | |
| 6,981,293 | B2 | 1/2006 | Steinberg | |
| 7,246,540 | B2 * | 7/2007 | Rillera | B25B 9/00 294/100 |
| 7,249,392 | B1 | 7/2007 | Paille | |
| D679,003 | S | 3/2013 | Jupin | |
| 8,438,686 | B2 * | 5/2013 | Morano | A47L 13/00 15/104.002 |
| 8,646,142 | B2 * | 2/2014 | Ferrara | A45D 34/04 132/320 |
| 2005/0160548 | A1 | 7/2005 | Girimont | |
| 2009/0106921 | A1 * | 4/2009 | Davitt | A45D 34/04 15/144.4 |
| 2012/0204372 | A1 * | 8/2012 | Kelly | A47K 7/08 15/210.1 |

* cited by examiner

*Primary Examiner* — Monica S Carter
*Assistant Examiner* — Katina N. Henson
(74) *Attorney, Agent, or Firm* — Maschoff Brennan

(57) ABSTRACT

A toiletry wiping device. The toiletry wiping device includes an elongated handle connected to a head having a pair of opposing jaws for clamping on objects positioned between the jaws. A sliding sleeve is mounted around the jaws that is configured to slide from one end of the jaws to the other end, causing the jaws to move towards and away from each other, respectfully. The head is pivotally connected to the elongated handle via hinge that allows a user to selectively adjust the relative angle of the head. In one embodiment, the handle includes a telescopic arrangement having one or more elongated sections that adjust the length of the handle. Further, one end of the jaws includes a high friction dry to prevent objects from accidentally slipping from between the jaws.

12 Claims, 5 Drawing Sheets

TOILETRY WIPING DEVICE

CROSS REFERENCE TO RELATED APPLICATION

This application claims the benefit of U.S. Provisional Application 62/258,706 filed on Nov. 23, 2015. The above identified patent application is herein incorporated reference in its entirety to provide continuity of disclosure.

BACKGROUND OF THE INVENTION

The present invention relates to a toiletry wiping device for assisting individuals with wiping themselves after going to the bathroom. More specifically, the present invention relates to an adjustable holder of toilet paper having a head connected to a handle, wherein the head includes a pair of opposing facing jaws that are movable between an open and closed position.

Many people, especially persons having limited hand/arm function, find it difficult to reach and hygienically wipe after toilet use. In addition, persons recovering from surgical or other medical procedures often have limited mobility that requires assistance with everyday tasks including natural bodily functions. The proper cleaning of one's anatomical region, particularly the anal and perineal regions of the body, after using the toilet is critical to proper and thorough hygiene.

Over the years, there have been attempts to provide toiletry wiping devices. However, these attempts have several shortcomings. One of the shortcomings is the closing mechanisms of these devices that hold the tissue paper therebetween, which are not in an optimal location for retaining and securing the tissue paper therebetween. An additional shortcoming is that these devices fail to provide an elongated handle with an end having a rotatable head that supports a pair of jaws adapted for gripping toilet paper. Further, the closing mechanisms of such devices fail to provide jaws that securely grip toilet or tissue paper therebetween, and the jaws do not easily fit between the cheeks of a buttock. Thus, there exists a need for a device that can securely grip toilet paper and assist persons having limited hand/arm function who may find it difficult to reach and hygienically wipe after toilet use.

In light of the devices disclosed in the prior art, it is submitted that the present invention substantially diverges in design elements from the prior art and consequently it is clear that there is a need in the art for an improvement to toiletry wiping devices. In this regard the instant invention substantially fulfills these needs.

SUMMARY OF THE INVENTION

In view of the foregoing disadvantages inherent in the known types of toiletry wiping devices now present in the prior art, the present invention provides a toiletry wiping device that utilizes a pair of jaws configured to grasp and release toilet paper upon the sliding of a sleeve mounted thereto.

It is therefore an object of the present invention to provide a new and improved toiletry wiping device that has all of the advantages of the prior art and none of the disadvantages.

The present invention relates to a toiletry wiping device comprising a handle coupled to a head having a pair of jaws configured to grasp toilet paper therebetween. The jaws are movable between an open position and a closed position by the actuating of a sleeve mounted thereto.

It is another object of the present invention to promote personal hygiene, especially for persons having limited hand/arm function. In particular, the present invention provides an elongated and extendable handle that assists the aforementioned persons with reaching and hygienically wiping the anatomical areas that require cleaning without excessive bending or moving.

It is therefore an object of the present invention to provide a toiletry wiping device that includes a rotatable gripping assembly that allows each user to selectively rotate the gripping assembly to a desired position for improved comfort and accuracy.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made acid used may be better understood after a review of the following description, taken in connection with the accompanying drawings wherein like numeral annotations are provided throughout.

DETAILED DESCRIPTION OF THE INVENTION

Figure 1:
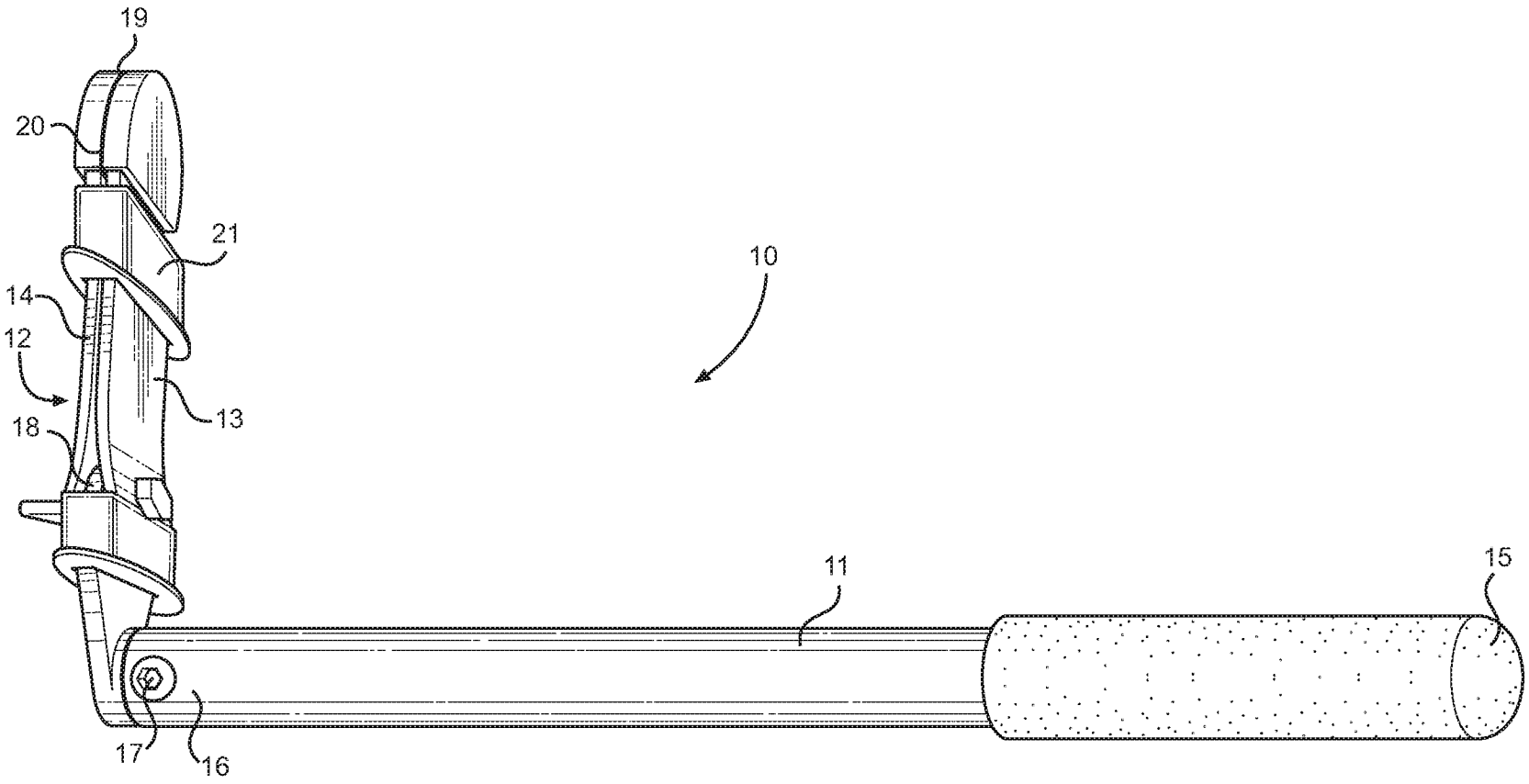
FIG. 1 shows a perspective view of one embodiment of the present invention.

Reference is made herein to the attached drawings. Like reference numerals are used throughout the drawings to depict like or similar elements of the toiletry wiping device. For the purposes of presenting a brief and clear description of the present invention, the preferred embodiment will be discussed as used for assisting individuals with wiping themselves after toilet use. The figures are intended for representative purposes only and should not be considered to be limiting in any respect.

Referring now to FIG. 1, there is shown a perspective view of one embodiment of the present invention. The toiletry wiping device 10 provides an apparatus for assisting individuals with hygienically wiping themselves after using a toilet. The toiletry wiping device 10 comprises an elongated handle 11 coupled to a head 12 having first jaw 13 and an opposing second jaw 14. In the shown embodiment, the elongated handle 11 includes a first end 15 and a second end 16, wherein the second end 16 is pivotally affixed via a hinge 17 to the head 12. The head 12 projects outwardly from the second end 16 of the handle 11. Each jaw 13, 14 includes a first fixed end 18 and a second free end 19 that defines a gap 20 between the jaws 13, 14 that is configured to receive toilet paper and the like. The jaws 13, 14 are configured be brought into close proximity to one another, thereby closing the gap 20, the moving translation of a sliding sleeve 21 along the longitudinal axis of the head 12.

The sliding sleeve 21 is mounted annularly around the first and second jaw 13, 14 and is configured to slide along the longitudinal axis of the head 12. The sliding sleeve 21 is movable between an open position and a closed position. When moved into the open position, the sliding sleeve 21 is disposed towards the first end 18 of the jaws 13, 14 and when moved into the closed position, the sliding sleeve 21 is disposed towards the second end 19 of the jaws 13, 14.

Figure 2:
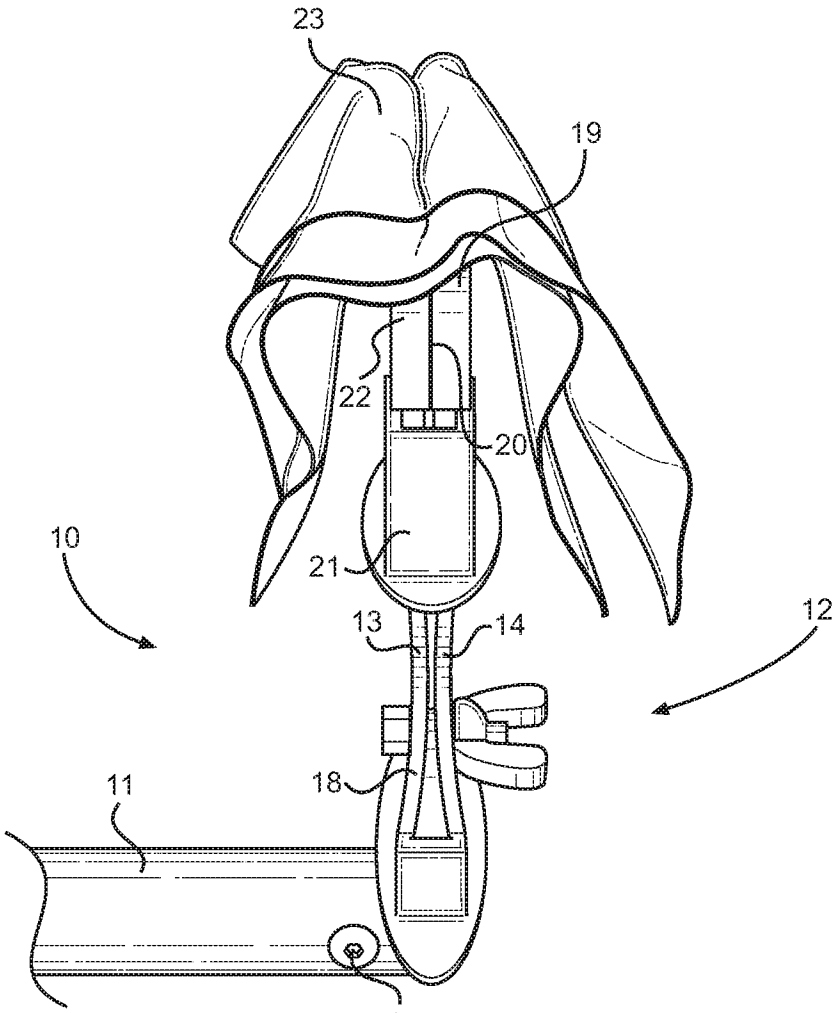
FIG. 2 shows a close-up view of one embodiment of the head of the present invention.

Referring now to FIG. 2, there is shown close-up view of one embodiment of the head of the present invention. The jaws 13, 14 are preferably sized for receiving a portion of toilet paper 23 therebetween. In the shown embodiment, the toiletry wiping device 10, which is clamping an the toilet paper 23 positioned between the jaws 13, 14, is in the closed position. In the closed position, the sliding sleeve 21 is positioned towards the second end 19 of the jaw 13, 14. When positioned towards the second end 19, the size of the gap 20 is decreased relative to the size of the gap 20 when in an open position. In the open position, the gap 20 provides for placement and/or removal of toilet paper 23 therebetween. Thus, as the jaws 13, 14 are being brought into close proximity to one other by the translation of the sliding sleeve 21 along the length of the jaws 13, 14, the jaws 13, 14 clamp down on objects, such as the toilet paper 23, positioned therebetween. The sliding sleeve 21 remains in either the open or closed position until the user moves the sleeve 21 into the other position.

In one embodiment, the jaws 13, 14 are curved plates that curve initially inwardly towards each other at the first end, then away from each other towards the second end, such that when the jaws 13, 14 are in the open position, the size of the gap 20 increases from the first end 18 to the second end 19. The sliding sleeve 21 includes a fixed circumference. Therefore, as the sliding sleeve 21 slides from first end 18 to the second end 19, the size of the gap 20 decreases, thereby enabling the toiletry wiping device 10 to clamp down on objects positioned within the gap 20. In an alternative embodiment, the jaws 13, 14 are shaped to form a V-shaped gap 20 therebetween. In either embodiment, translation of the sliding sleeve 21 along the length of the jaws 13, 14 causes the jaws 13, 14 to open and close, respectfully.

In the shown embodiment, the head 12 extends at a right angle from the elongated handle 11 at the hinge 17. However, the pivotally affixed head 12 may be positioned at any angle relative to the handle 11. The head 12 is affixed to the handle 11 via a pin. In alternative embodiments, any suitable fastener configured to couple the head 12 to the handle 11 may be utilized. In this way, the head 12 is interchangeable with other substantially similar heads 12 should they need replacement.

In the shown embodiment, the second end 19 of the jaws 13, 14 comprises a high friction tip 22 configured to prevent toilet paper from accidental slipping or otherwise begin removal from between the jaws 13, 14. The second end 19 of the jaws 13, 14 are curved; however in alternative embodiments the second end 19 may include any suitable shape.

Figure 3:
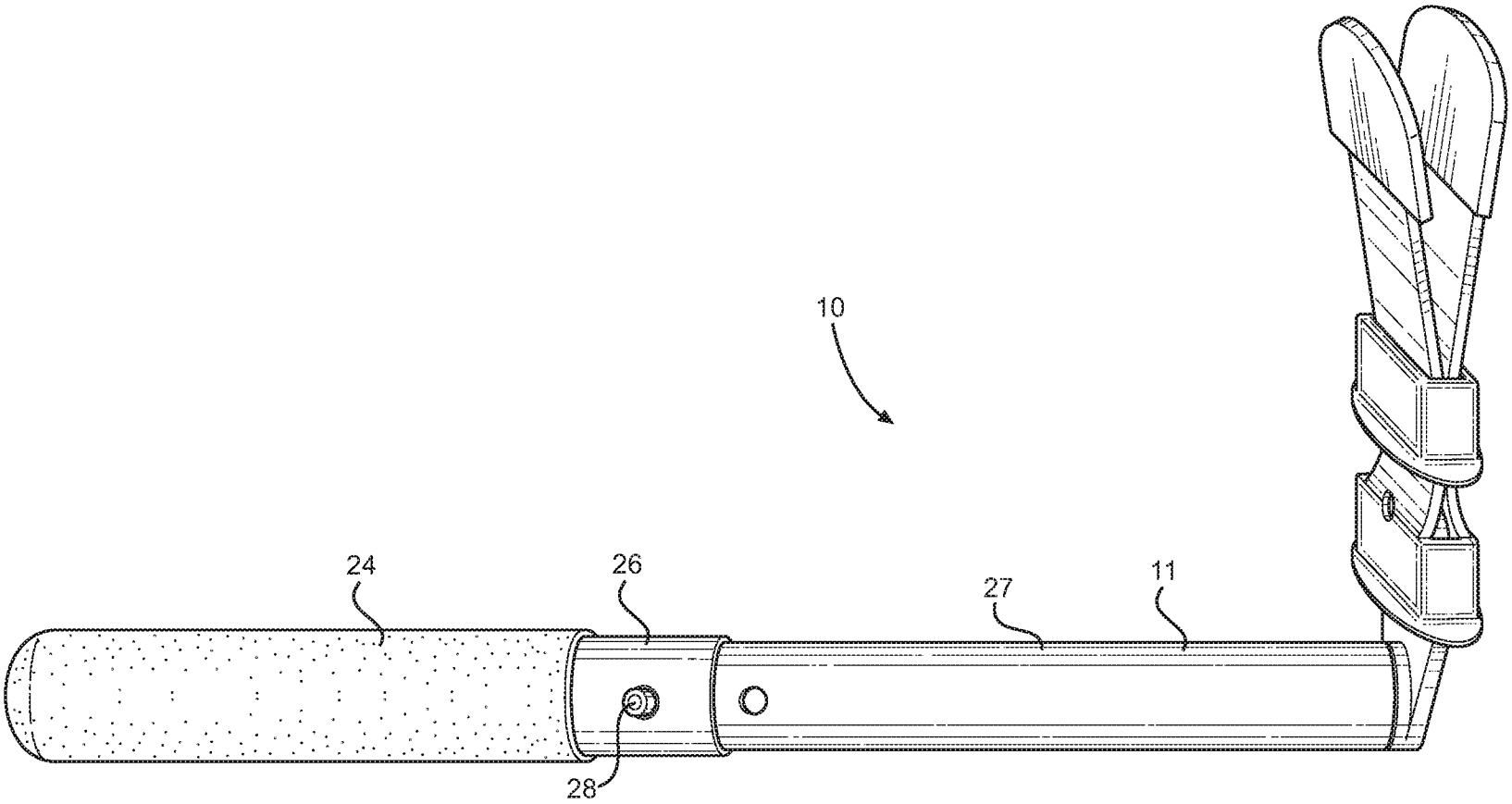
FIG. 3 shows a perspective view of another embodiment of the present invention.

Referring now to FIG. 3, there is shown a perspective view of one embodiment of the present invention. In one embodiment, the elongated handle 11 includes a padded member 24 configured for ergonomic gripping by a user. The handle 11 is a cylindrical rod having an ergonomic design that enables a user to comfortably and securely toiletry wiping device 10 with one hand. In one embodiment, the cylindrical rod is constructed from durable aluminum, approximately one foot long.

In an alternative embodiment, the handle 11 may also be extendable and/or telescoping. The handle 11 comprises one or more elongated sections 26, 27. In the shown embodiment, a first elongated section 26 is adjustably secured to a second elongated section 27 so as to allow the handle 11 to extend into an extended configuration and retract into a retracted configuration. This telescopic arrangement of the elongated sections 26, 27 provides for adjustment of the linear length of the handle 11. The elongated sections 26, 27 are fastened to one another via any suitable fastener, such as a quick release pin 28. The fastener allows a user to select a desired handle length. In the illustrated embodiment, the elongated sections 26, 27 are tubular members comprising a circular cross-section, however in alternative embodiments, the elongated sections 26, 27 may comprise any suitable cross-sectional shape. The telescopic arrangement of the handle 11 enables users to extend or retract the linear length of the elongated handle 11 for convenient use.

Figure 4:
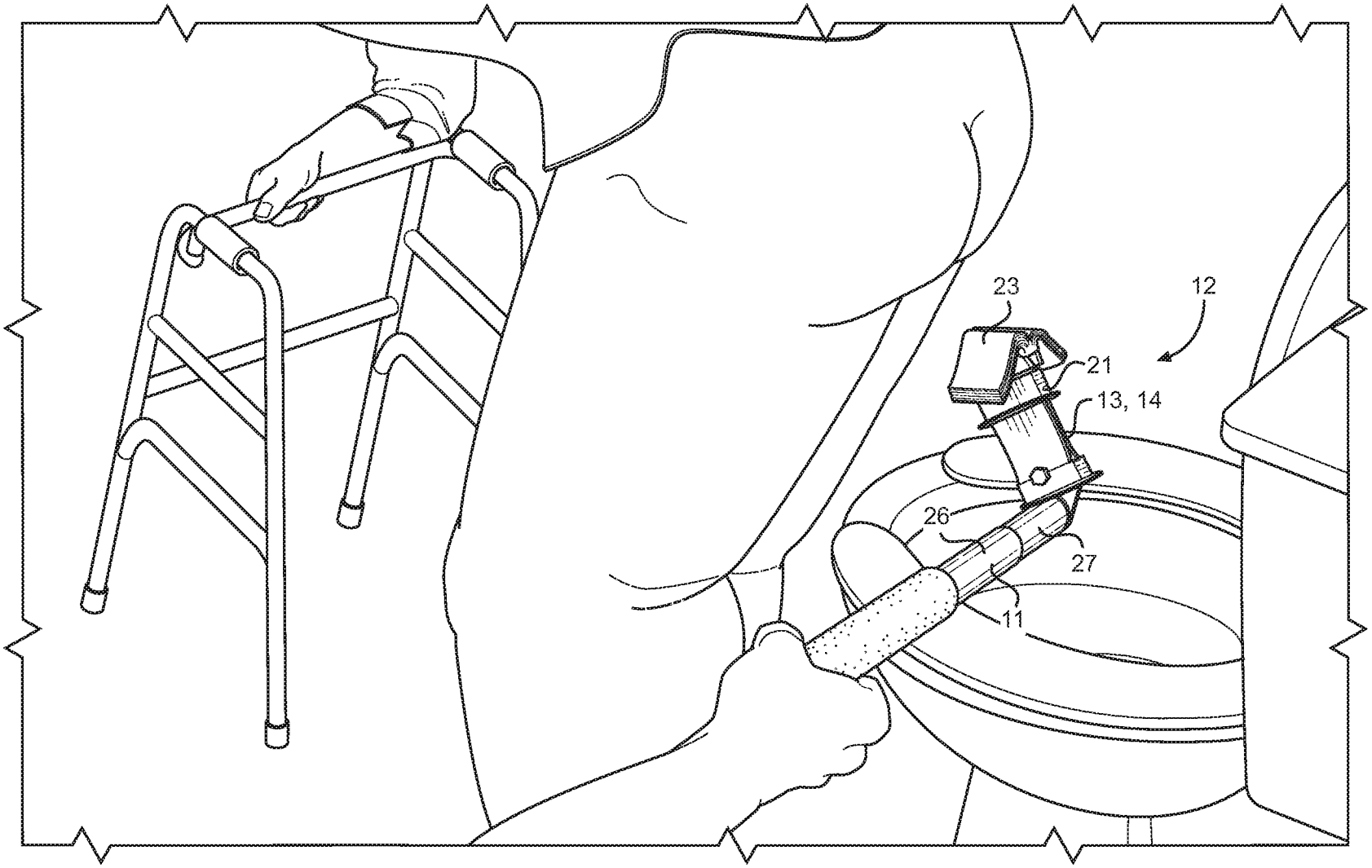
FIG. 4 shows a perspective view of one embodiment of the present invention in one use.
Figure 5:
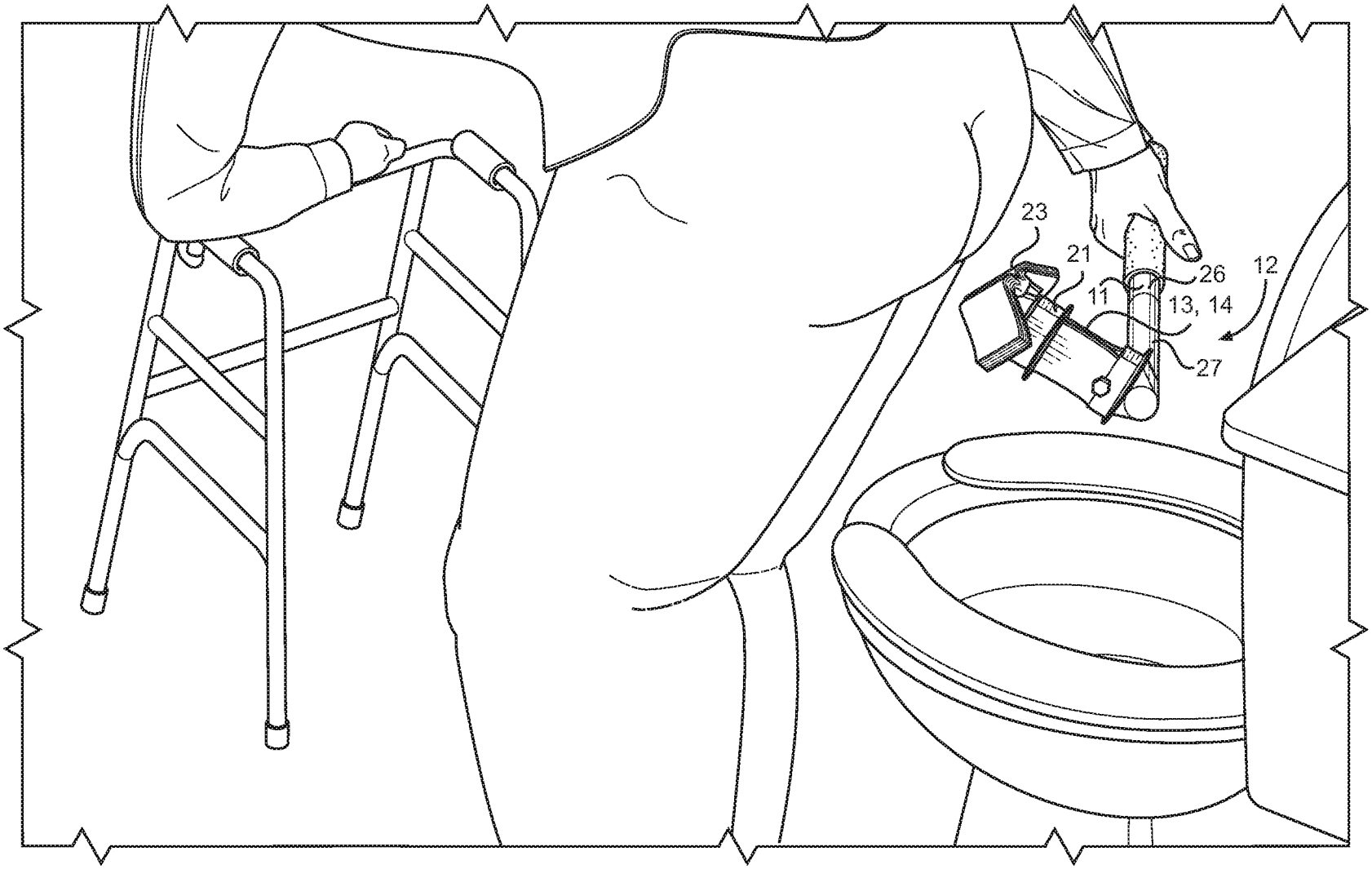
FIG. 5 shows a perspective view of one embodiment of the present invention in another use.

Referring now to FIGS. 4 and 5, there are shown a perspective views of one embodiment of the present invention in two uses. In one operation (FIG. 5), a user grips one of the elongated sections 26, 27 of the handle 11 and positions the sliding sleeve 21 of the head 12 into an open position. The user then places toilet paper 23, or the like, between the jaws 13, 14 and slides the sleeve 21 from the first end towards the second end of the jaws 13, 14, thus causing the jaws 13, 14 to clamp down on the toilet paper 23. Once the toilet paper 23 is secured between the jaws 13, 14, the angle of the head 12 relative to the handle 11 may also be adjusted to ensure that the toileting wiping device 10 may be comfortably utilized to reach the buttock of the user. Next, the user may use the toiletry wiping device 10 to after using the toilet. The used toilet paper 23 may then be released from the jaws 13, 14 by sliding the sleeve 21 towards the first end 18 of the jaws 13, 14. In another operation (FIG. 4) the user is assisted by another individual who may use the toiletry wiping device 10, in a similar manner as described above, to wipe the user after using the toilet.

It is therefore submitted that the instant invention has been shown and described in what is considered to be the most practical and preferred embodiment. It is recognized, however, that departures may be made within the scope of the invention and that obvious modifications will occur to a person skilled in the art. With respect to the above description then, it to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toiletry wiping device, comprising:

a handle perpendicularly affixed to a head at an outermost distal end thereof, wherein the head includes a first jaw and a second jaw extending therefrom;

wherein the first jaw and the second jaw are each statically fixed to the head at a first end thereof and free at a second end thereof, the first jaw including a first curved plate that curves inwardly towards the second jaw at the first end thereof and outwardly away from the second jaw at the second end thereof, the second jaw including a second curved plate that curves inwardly towards the first plate at the first end thereof and outwardly away from the first jaw at the second end thereof, the inward curve of the first plate and the inward curve of the second plate forming a void into which a base of the head projects, the base of the head directly interfacing with the handle;

a sliding sleeve slidably mounted annularly around the first jaw and the second jaw, wherein the sliding sleeve is configured to slide along the first jaw and the second jaw and includes an annular lip disposed about a proximal portion thereof;

wherein the second end of each of the first jaw and the second jaw includes an arcuate portion thereon;

wherein when the sliding sleeve is disposed toward the first end of each of the first jaw and the second jaw, the sliding sleeve releases the second end of each of the first jaw and the second jaw to place the toiletry wiping device in an open position;

wherein when the sliding sleeve is disposed toward the second end of each of the first jaw and the second jaw, the sliding sleeve compresses the second end of each of the first jaw and the second jaw to place the toiletry wiping device in a closed position;

wherein when the toiletry wiping device is in the open position, a size of a gap between the first jaw and the second jaw is increased to receive and release toilet paper therein and therefrom, respectively;

wherein when the toiletry wiping device is in the closed position, the size of the gap between the first jaw and the second jaw is decreased to secure the toilet paper therein.

2. The toiletry wiping device of claim 1, wherein the second end of each of the first jaw and the second jaw includes a high friction tip thereon.

3. The toiletry wiping device of claim 1, wherein the handle includes one or more elongated sections movable between a retracted position and an extended position;

wherein the one or more elongated sections are configured to cooperate in a telescoping arrangement.

4. The toiletry wiping device of claim 2, wherein the high friction tip is dimensioned to abut the sliding sleeve when the sliding sleeve is disposed at the second end of each of the first jaw and the second jaw.

5. The toiletry wiping device of claim 1, wherein the sliding sleeve remains a fixed circumference about the first jaw and the second jaw.

6. The toiletry wiping device of claim 1, wherein a first jaw size and a first jaw shape of the first jaw are similar to a size and a shape of the second jaw, respectively.

7. The toiletry wiping device of claim 1, wherein a first length between the first and the second ends of the first jaw is equal to a second length between the first and the second ends of the second jaw.

8. The toiletry wiping device of claim 1, wherein the first jaw and the second jaw are simultaneously actuated upon transition of the sliding sleeve between the first and the second ends thereof.

9. A toiletry wiping device, comprising:

a telescopic handle perpendicularly coupled to a head on a distal end of the telescopic handle, wherein the head projects outward from the distal end to form a right angle between the telescopic handle and the head, wherein a proximal end of the telescopic handle includes a padded member attached thereto;

a pair of movable jaws, wherein each movable jaw of the pair of movable jaws extends from the head at a first end of the movable jaw and includes a high friction tip on a second end of the movable jaw, the pair of movable jaws including curved plates that curve inwardly towards each other at the first end and outwardly away from each other at the second end, the inward curve of the pair of movable jaws forming a void into which a base of the head projects, the base of the head directly interfacing with the telescopic handle;

a sliding sleeve annularly affixed about the pair of movable jaws;

wherein when the sliding sleeve is disposed toward the first end of each movable jaw of the pair of movable jaws, the sliding sleeve releases the movable jaws to increase a gap between the high friction tips and place the toiletry wiping device in an open position;

wherein when the sliding sleeve is disposed toward the second end of each movable jaw of the pair of movable jaws, the sliding sleeve compresses the movable jaws together to decrease the gap between the high friction tips and place the toiletry wiping device in a closed position;

wherein when the toiletry wiping device is in the open position, the high friction tips are configured to receive and release toilet paper therein and therefrom, respectively;

wherein when the toiletry wiping device is in the closed position, the high friction tips are configured to secure toilet paper therein.

10. The toiletry wiping device of claim 9, wherein the telescopic handle is hingedly coupled to the head by a hinge, wherein the angle is adjustable via a hinged movement of the head relative to the handle.

11. A toiletry wiping device, consisting of:

a telescopic handle perpendicularly coupled to a head on a distal end of the telescopic handle, wherein the head projects outward from the distal end to form a right angle between the telescopic handle and the head, wherein a proximal end of the telescopic handle includes a padded member attached thereto;

a pair of movable jaws, wherein each movable jaw of the pair of movable jaws extends from the head at a first end of the movable jaw and includes a high friction tip on a second end of the movable jaw, the pair of movable jaws including curved portions that curve inwardly towards each other at the first end and outwardly away from each other at the second end, the inward curve of the pair of movable jaws forming a void into which a base of the head projects, the base of the head directly interfacing with the telescopic handle;

a sliding sleeve annularly affixed about the pair of movable jaws;

wherein when the sliding sleeve is disposed toward the first end of each movable jaw of the pair of movable jaws, the sliding sleeve releases the movable jaws to increase a gap between the high friction tips and place the toiletry wiping device in an open position;

wherein when the sliding sleeve is disposed toward the second end of each movable jaw of the pair of movable jaws, the sliding sleeve compresses the movable jaws together to decrease the gap between the high friction tips and place the toiletry wiping device in a closed position;

wherein when the toiletry wiping device is in the open position, the high friction tips are configured to receive and release toilet paper therein and therefrom, respectively;

wherein when the toiletry wiping device is in the closed position, the high friction tips are configured to secure toilet paper therein.

12. The toiletry wiping device of claim 11, wherein the telescopic handle is hingedly coupled to the head by a hinge, wherein the angle is adjustable via a hinged movement of the head relative to the handle.

* * * * *